US010580387B2

(12) United States Patent
Lim et al.

(10) Patent No.: US 10,580,387 B2
(45) Date of Patent: Mar. 3, 2020

(54) DATA DRIVING DEVICE AND DISPLAY DEVICE INCLUDING THE SAME

(71) Applicant: SILICON WORKS CO., LTD., Daejeon-si (KR)

(72) Inventors: Hun Yong Lim, Daejeon-si (KR); Yong Min Kim, Daejeon-si (KR); Ju Ho Lee, Daejeon-si (KR)

(73) Assignee: Silicon Works Co., Ltd., Daejeon-si (KR)

( * ) Notice: Subject to any disclaimer, the term of this patent is extended or adjusted under 35 U.S.C. 154(b) by 71 days.

(21) Appl. No.: 15/811,921

(22) Filed: Nov. 14, 2017

(65) Prior Publication Data

US 2018/0144723 A1 May 24, 2018

(30) Foreign Application Priority Data

Nov. 22, 2016 (KR) ..... 10-2016-0156017

(51) Int. Cl.
*G09G 5/18* (2006.01)
*G09G 3/20* (2006.01)

(52) U.S. Cl.
CPC ..... *G09G 5/18* (2013.01); *G09G 3/20* (2013.01); *G09G 3/2092* (2013.01); *G09G 2310/0245* (2013.01); *G09G 2310/0275* (2013.01); *G09G 2310/061* (2013.01); *G09G 2310/062* (2013.01); *G09G 2310/063* (2013.01); *G09G 2310/08* (2013.01)

(58) Field of Classification Search
CPC ..... G09G 5/18; G09G 3/2092; G09G 3/20; G09G 2310/08; G09G 2310/062; G09G 2310/061; G09G 2310/0275; G09G 2310/063; G09G 2310/0245; G09G 2310/0264
See application file for complete search history.

(56) References Cited

U.S. PATENT DOCUMENTS

2010/0149082 A1* 6/2010 Hong ..... G09G 3/3611 345/88
2014/0118235 A1* 5/2014 Hong ..... G09G 5/008 345/87
2015/0187315 A1* 7/2015 Park ..... G09G 3/3685 345/99
2015/0310824 A1* 10/2015 Yang ..... G09G 5/006 345/213
2016/0351129 A1* 12/2016 Kim ..... G09G 3/3258

FOREIGN PATENT DOCUMENTS

| | | |
|---|---|---|
| KR | 10-1267019 | 5/2013 |
| KR | 10-2015-0079011 | 7/2015 |
| KR | 10-2015-0079314 | 7/2015 |
| KR | 10-1609250 | 4/2016 |
| KR | 10-2016-0053070 | 5/2016 |

* cited by examiner

*Primary Examiner* — Brent D Castiaux
(74) *Attorney, Agent, or Firm* — Polsinelli

(57) ABSTRACT

Disclosed are a data driving device and a display device including the same. The display device may include: a timing controller configured to include lock fail data in an input signal and transmit the input signal in each preset period; and a source driver configured to recover the lock fail data from the input signal, and reset an internal circuit in response to the recovered lock fail data.

11 Claims, 5 Drawing Sheets

DATA DRIVING DEVICE AND DISPLAY DEVICE INCLUDING THE SAME

BACKGROUND

1. Technical Field

The present disclosure relates to a display device, and more particularly, to a data driving device that periodically resets a source driver and a display device including the same.

2. Related Art

A display device includes a display panel, a source driver, a gate driver, a timing controller and the like. The source driver converts digital image data provided from the timing controller into a source driving signal, and provides the source driving signal to the display panel.

The display device may be employed in a vehicle, and a power drop may occur depending on an environment of the vehicle, when a functional operation of the vehicle is performed. For example, a power drop may occur during a starting operation, horn operation, seat change operation or washer operation of the vehicle. In this case, the source driver may malfunction.

The source driver which is driven in the above-described vehicle environment may not satisfy the power spec during the function operation of the vehicle. In this case, a white screen such as a partial whiten screen or line white screen may be displayed. Therefore, there is a demand for a technique capable of returning an abnormal screen such as a white screen to a normal screen.

SUMMARY

Various embodiments are directed to a driving device capable of resetting a source driver in each preset period and a display device including the same.

In an embodiment, a display device may include: a timing controller configured to include lock fail data in an input signal and transmit the input signal in each preset period; and a source driver configured to recover the lock fail data from the input signal, and reset an internal circuit in response to the recovered lock fail data.

In another embodiment, a display device may include: a timing controller configured to transmit a reset signal in each preset period; and a source driver configured to reset an internal circuit in response to the reset signal. The timing controller and the source driver may be connected to each other through a dedicated transmission line to transmitting the reset signal.

In another embodiment, a data driving device may include: a recovery circuit configured to recover one or more of lock fail data, digital image data, control data and a clock signal which are included in an input signal; a logic circuit configured to process the recovered digital image data; and an arithmetic circuit configured to generate a first reset signal in response to a lock signal corresponding to the recovered lock fail data, and output the first reset signal to the CDR and the logic circuit.

DETAILED DESCRIPTION

Figure 1:
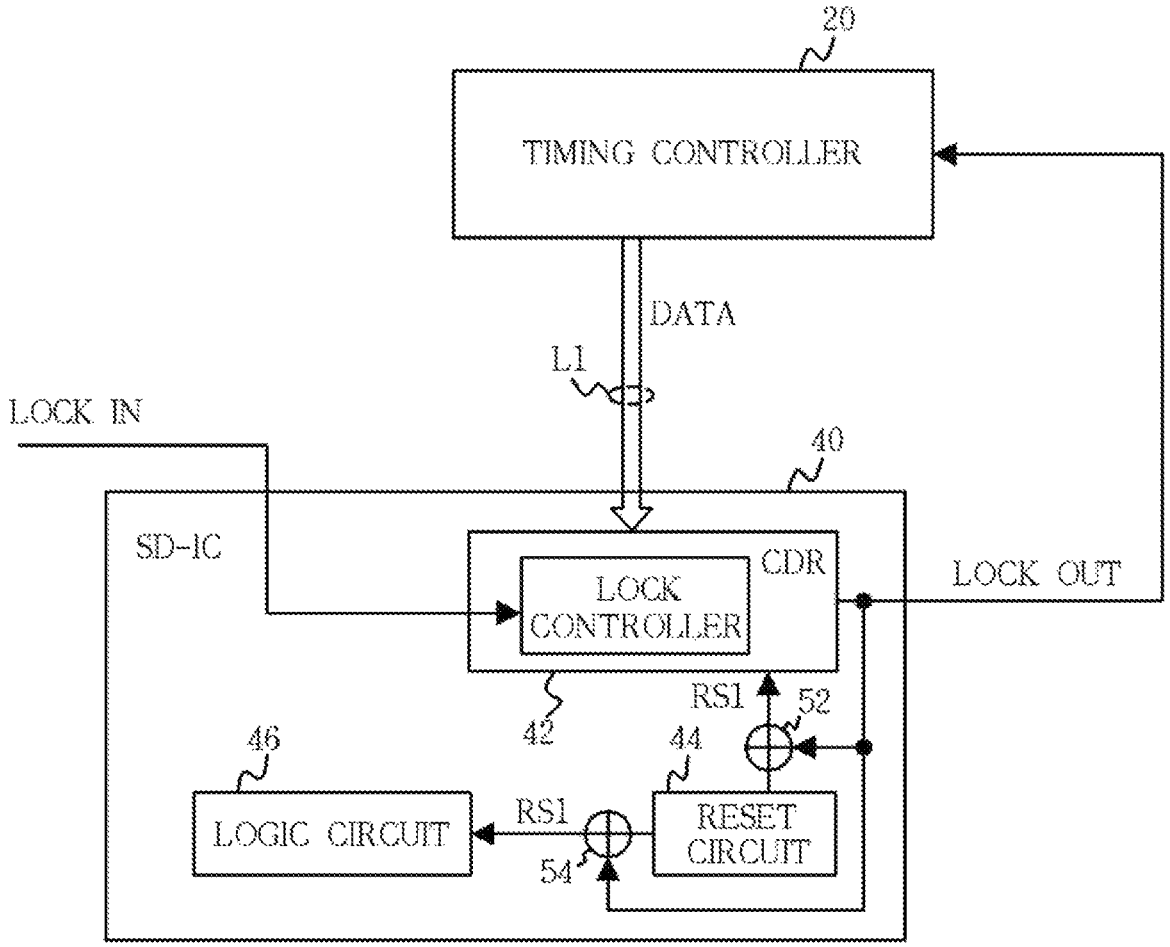
FIG. 1 is a block diagram illustrating a display device according to an embodiment of the present invention.

Hereafter, embodiments of the present invention will be described in detail with reference to the accompanying drawings. The terms used in the present specification and claims are not limited to typical dictionary definitions, but must be interpreted as meanings and concepts which coincide with the technical idea of the present invention.

Embodiments described in the present specification and configurations illustrated in the drawings are preferred embodiments of the present invention, and do not represent the entire technical idea of the present invention. Thus, various equivalents and modifications capable of replacing the embodiments and configurations may be provided at the point of time that the present application is filed.

FIG. 1 is a block diagram illustrating a display device according to an embodiment of the present invention.

Referring to FIG. 1, the display device according to the embodiment of the present invention includes a timing controller 20 and a plurality of source drivers 40. For convenience of description, FIG. 1 illustrates only one source driver 40.

The timing controller 20 provides digital image data to the source driver 40, and controls the source driver 40 and a gate driver (not illustrated) such that a source driving signal corresponding to digital image data is correctly supplied to a display panel (not illustrated).

The timing controller 20 includes lock fail data in an input signal DATA in each preset period, and transmits the input signal DATA to the source driver 40. The preset period may be set to a part of a vertical blank time between frames. For example, the timing controller 20 may include lock fail data in the input signal DATA and transmit the input signal DATA, in each frame.

During a display time, the timing controller 20 includes a clock signal, digital image data and control data in the input signal DATA and transmits the input signal DATA to the source driver 40 through a pair of data transmission lines L1. During a part of the vertical bland period, the timing controller 20 includes lock fail data in the input signal DATA and transmits the input signal DATA to the source driver 40.

During the display time, the source driver 40 recover the clock signal, the digital image data and the control data from the input signal DATA provided from the timing controller 20, sorts the recovered digital image data, converts the sorted digital image data into an analog source driving signal, and supplies the source driving signal to data lines of the display panel. One source driver may be implemented by one integrated circuit SD-IC, and the number of the source drivers 40 may be set in consideration of the size and resolution of the display panel.

The source driver 40 includes a CDR (Clock and Data Recovery circuit) 42, a logic circuit 46, a reset circuit 44 and arithmetic circuits 52 and 54. The CDR 42 recovers the clock signal, the digital image data and the control data from the input signal DATA in the display time, and recovers the lock fail data from the input signal DATA in a vertical blank time between frames.

The logic circuit 46 processes the digital image data recovered by the CDR 42, and the reset circuit 44 resets the CDR 42 and the logic circuit 46 during power on. The CDR 42 includes a lock controller configured to transmit a lock signal LOCK OUT to the timing controller 20 in response to a lock signal LOCK IN provided from a neighboring source driver.

The arithmetic circuits 52 and 54 generate a reset signal RS1 in response to the lock signal LOCK OUT corresponding to the recovered lock fail data, and output the generated reset signal RS1 to the CDR 42 and the logic circuit 46. At this time, the arithmetic circuits 52 and 54 enable the reset signal RS1 in response to at least one of the lock signal LOCK OUT corresponding to the lock fail data and an output signal of the reset circuit 44, the output signal being enabled during power on. For example, the arithmetic circuits 52 and 54 may include a circuit configured to perform an AND operation on the lock signal LOCK OUT and the output signal of the reset circuit 44.

The source driver 40 may further include a shift register, a latch, a digital-analog converter, an output buffer and the like, in order to provide the source driving signal corresponding to the digital image data to the display panel.

According to an embodiment of the present invention, the timing controller includes the lock fail data in the input signal DATA in each frame and transmits the input signal DATA to reset the source driver. Thus, although a screen abnormality occurs in a specific frame, the abnormal screen can be returned to a normal screen in the next frame.

The display device according to the embodiment of the present invention resets the CDR 42 and the logic circuit 46 of the source driver 40. However, the display device may reset another internal circuit for processing digital image data.

The source driver 40 may be configured to perform clock training such that the phase frequency of the clock signal can be stably locked while the logic level of the lock signal LOCK OUT is low.

Figure 2:
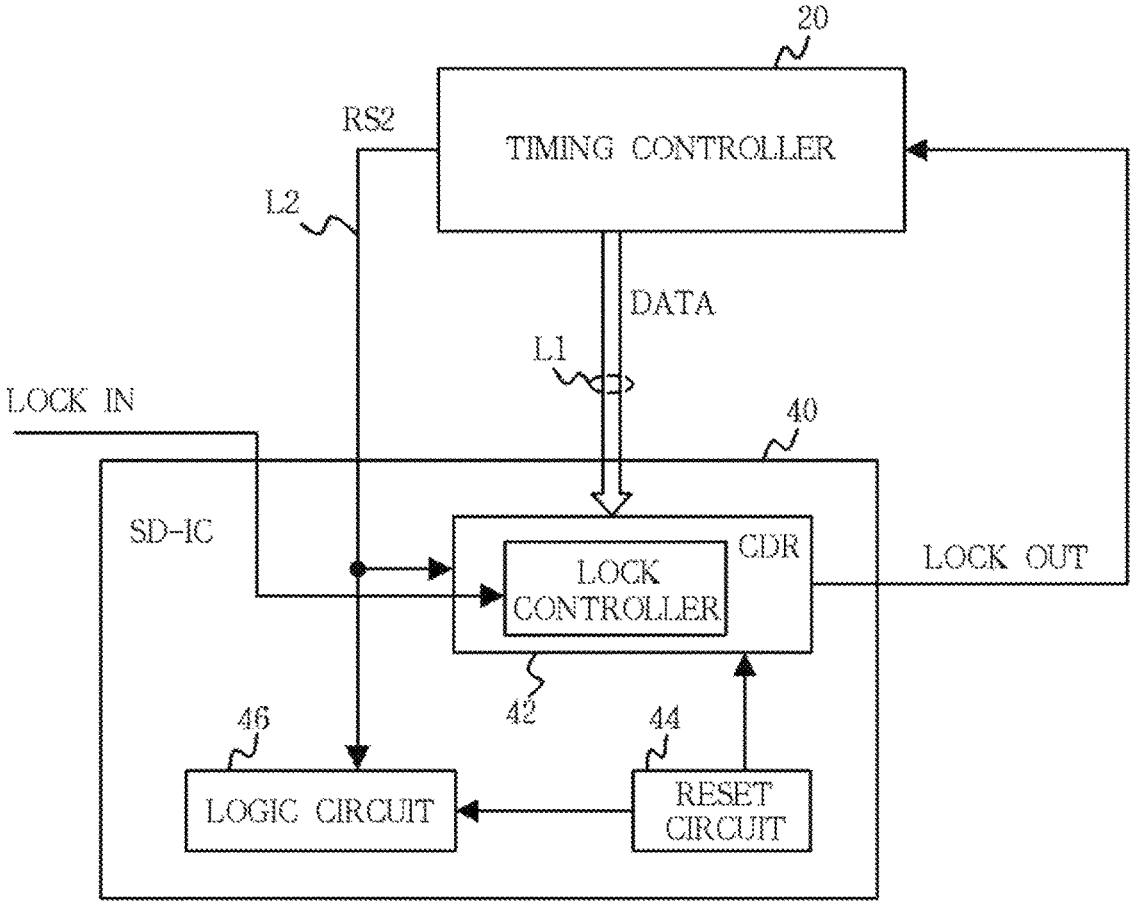
FIG. 2 is a block diagram illustrating a display device according to another embodiment of the present invention.

FIG. 2 is a block diagram illustrating a display device according to another embodiment of the present invention.

Referring to FIG. 2, the display device according to the present embodiment includes a timing controller 20 and a source driver 40. The timing controller 20 transmits a reset signal RS2 through a dedicated transmission line L2 in each preset period, and the source driver 40 resets an internal circuit in response to the reset signal RS2.

The timing controller 20 and the source driver 40 are connected through a pair of data transmission lines L1 to transmit an input signal DATA, and connected through the dedicated transmission line L2 dedicated to transmitting the reset signal RS2.

For example, during a display time, the timing controller 20 may include a clock signal, digital image data and control data in the input signal DATA and transmit the input signal DATA to the source driver 40 through the pair of data transmission lines L1. During a part of a vertical bland period, the timing controller 20 may transmit the reset signal RS2 through the dedicated transmission line L2.

The source driver 40 includes a CDR 42, a logic circuit 46 and a reset circuit 44. The CDR 42 recovers the clock signal, the digital image data and the control data from the input signal DATA in the display time, the logic circuit 46 processes the digital image data recovered by the CDR 42, and the reset circuit 44 resets the CDR 42 and the logic circuit 46 during power on.

The CDR 42 and the logic circuit 46 are reset in response to the reset signal RS2 transmitted through the dedicated transmission line L2 from the timing controller 20 in each preset cycle.

According to the present embodiment, the reset signal RS2 is transmitted to the source driver through the dedicated transmission line L2 in each frame, in order to reset the internal circuits. Thus, although a screen abnormality occurs in a specific frame, the abnormal screen can be returned to a normal screen in the next frame.

Figure 3:
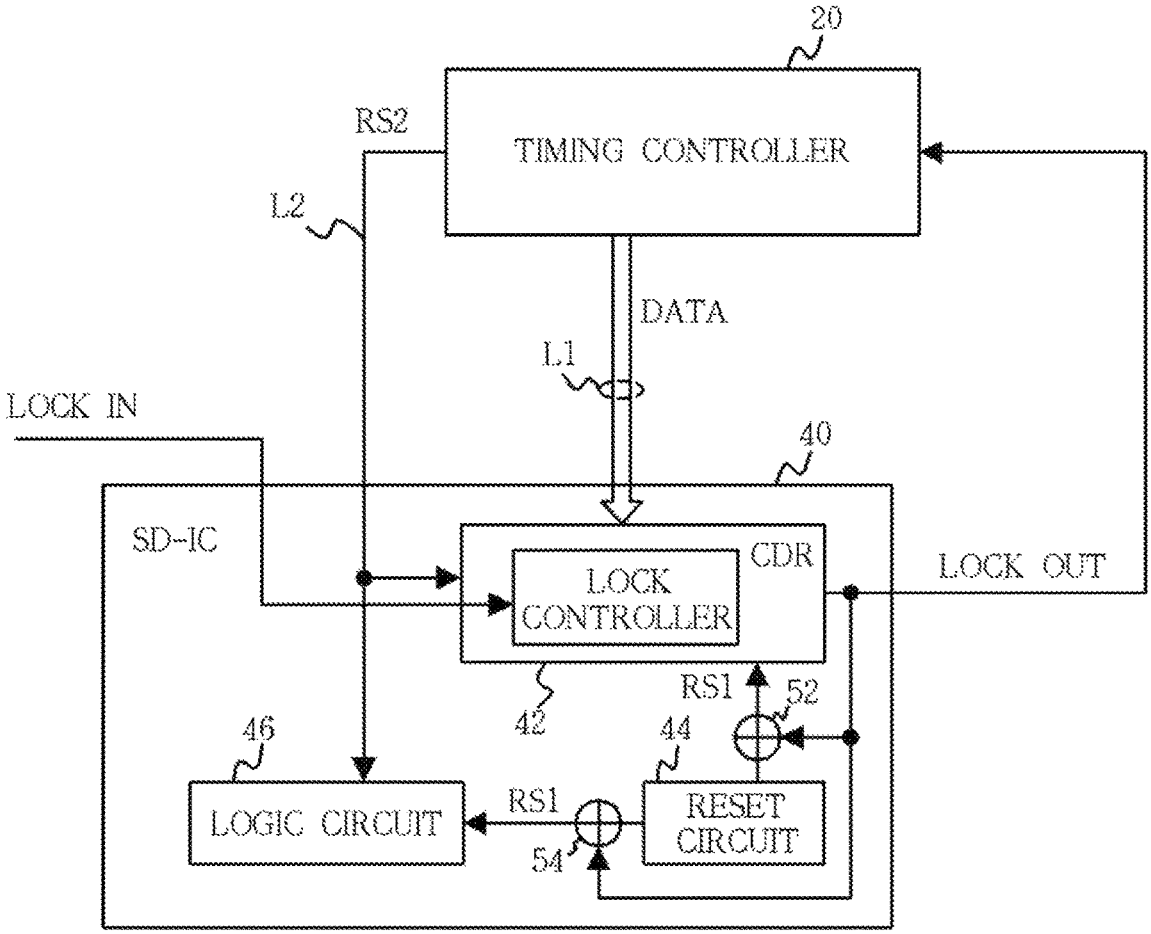
FIG. 3 is a block diagram illustrating a display device according to still another embodiment of the present invention.

FIG. 3 is a block diagram illustrating a display device according to still another embodiment of the present invention.

Referring to FIG. 3, the display device according to the present embodiment includes a timing controller 20 and a source driver 40.

The timing controller 20 and the source driver 40 are connected through a pair of data transmission lines L1 to transmit an input signal DATA, and connected through a dedicated transmission line L2 dedicated to transmitting a reset signal RS2.

The timing controller 20 includes lock fail data in the input signal DATA in each preset period, and transmits the input signal DATA to the source driver 40 through the pair of data transmission lines L1 or transmits the reset signal RS2 to the source driver 40 through the dedicated transmission line L2.

At this time, the preset period may be set to a part of the vertical blank time between frames, and the timing controller 20 may perform at least one of the operation of including the lock fail data in the input signal DATA and transmitting the input signal DATA to the source driver 40 through the pair of data transmission lines L1 and the operation of transmitting the reset signal RS2 to the source driver 40 through the dedicated transmission line L2, in each frame.

The source driver 40 includes a CDR 42, a logic circuit 46 and arithmetic circuits 52 and 54. The CDR 42 recovers the lock fail data included in the input signal, the logic circuit 46 sorts digital image data, and the arithmetic circuits 52 and 54 output a reset signal RS1 in response to a lock signal LOCK OUT corresponding to the lock fail data.

The arithmetic circuits 52 and 54 enable the reset signal RS1 in response to at least one of the lock signal LOCK OUT corresponding to the lock fail data and an output signal of the reset circuit 44, the output signal being enabled during power on.

The CDR 42 and the logic circuit 46 receive the reset signal RS2 from the timing controller 20 in each preset period, and are reset in response to at least one of the reset signal RS1 and RS2.

According to the present embodiment, the timing controller includes the lock fail data in the input signal DATA and transmits the input signal DATA or transmits the reset signal RS2 through the dedicated transmission line L2 in each preset period, in order to reset the internal circuits of the source driver 40. Thus, although a screen abnormality occurs in a specific frame, the abnormal screen can be returned to a normal screen in the next frame.

Figure 4:
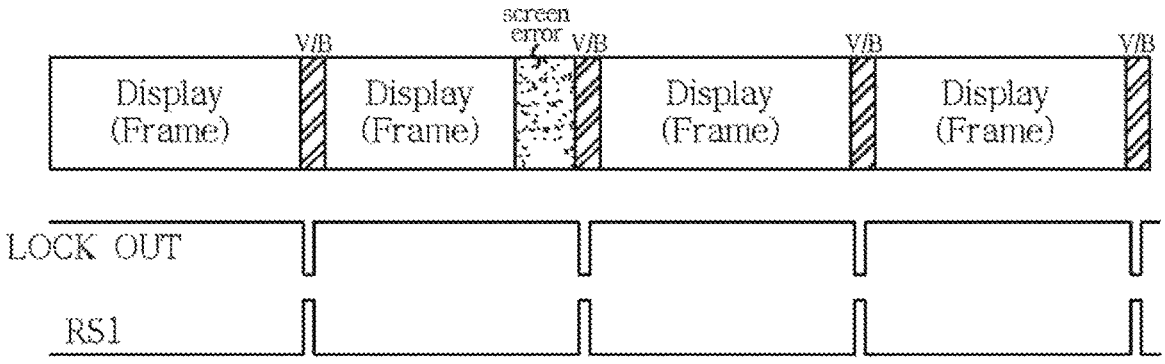
FIG. 4 is a timing diagram of the display device according to the embodiments of the present invention.

FIG. 4 is a timing diagram of the display device according to the embodiment of the present invention.

Referring to FIG. 4, the display device according to the embodiment of the present invention causes a lock fail in the lock signal LOCK OUT and enables the reset signal RS1 through the lock fail, in a part of the vertical blank time V/B.

As illustrated in FIG. 4, the display device according to the embodiment of the present invention resets the internal circuits of the source driver in each frame. Thus, although a screen abnormality occurs in a specific frame, the abnormal screen can be returned to a normal screen in the next frame.

The display device according to the embodiment of the present invention enables the reset signal in each frame. However, the display device may enable the reset signal at each interval of a plurality frames.

Figure 5:
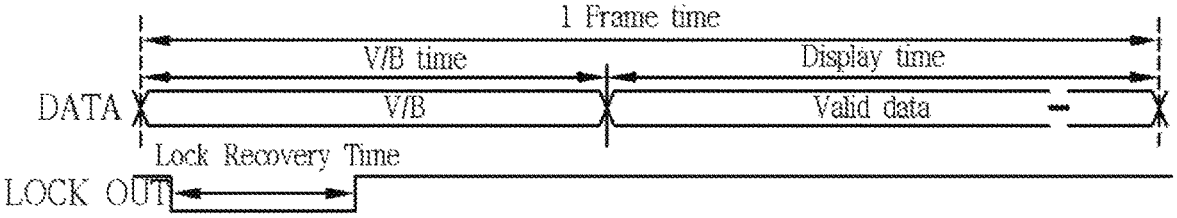
FIG. 5 is a timing diagram illustrating that a part of a vertical blank time illustrated in FIG. 4 is used as a reset time.

FIG. 5 is a timing diagram illustrating that a part of the vertical blank time illustrated in FIG. 4 is used as a reset time.

Referring to FIG. 5, the display device according to the embodiment of the present invention may use a part of the vertical blank time VB as a time for resetting the internal circuits of the source driver 40.

The source driver 40 may be reset to perform clock training such that the phase frequency of the clock signal can be stably locked while the logic level of the lock signal LOCK OUT is low.

The display device according to the embodiment of the present invention resets the source driver in each frame or at each interval of a plurality of frames. Thus, although a screen abnormality occurs in a specific frame, the abnormal screen can be returned to a normal screen in the next frame. Furthermore, when the display device is employed in a vehicle, an abnormal screen caused by a power drop during a functional operation of the vehicle can be returned to a normal screen in the next frame, which makes it possible to support safety driving.

While various embodiments have been described above, it will be understood to those skilled in the art that the embodiments described are by way of example only. Accordingly, the disclosure described herein should not be limited based on the described embodiments.

What is claimed is:

1. A display device comprising:

a timing controller configured to transmit an input signal including lock fail data to reset an internal circuit of a source driver in each preset period; and the source driver configured to recover the lock fail data from the input signal, and reset the internal circuit in response to the recovered lock fail data activated in the preset period, wherein the preset period is set to at least one frame, and wherein the timing controller transmits the lock fail data to the source driver at intervals of the at least one frame.

2. The display device of claim 1, wherein the timing controller transmits the input signal including the lock fail data during a part of a vertical blank time.

3. The display device of claim 2, wherein the source driver performs clock training during the part of the vertical blank time.

4. The display device of claim 1, wherein the source driver comprises:

a recovery circuit configured to recover one or more of the lock fail data, digital image data, control data and a clock signal which are included in the input signal;

a logic circuit configured to process the recovered digital image data; and an arithmetic circuit configured to output a reset signal to at least one of the recovery circuit and the logic circuit in response to a lock signal corresponding to the recovered lock fail data.

5. The display device of claim 4, wherein the arithmetic circuit enables the reset signal in response to at least one of the lock signal and an output signal of a reset circuit, the output signal being enabled during power on.

6. A display device comprising:

a timing controller configured to transmit a reset signal to reset an internal circuit of a source driver in each preset period; and the source driver configured to reset the internal circuit in response to the reset signal activated in the preset period, wherein the timing controller and the source driver are connected to each other through a dedicated transmission line to transmitting the reset signal, wherein the preset period is set to at least one frame, and wherein the timing controller transmits the lock fail data to the source driver at intervals of the at least one frame.

7. The display device of claim 6, wherein the source driver comprises:

a recovery circuit configured to recover one or more of digital image data, control data and a clock signal; and a logic circuit configured to process the recovered digital image data, wherein the recovery circuit and the logic circuit are reset in response to the reset signal.

8. A data driving device comprising:

a recovery circuit configured to recover one or more of lock fail data to reset an internal circuit of a source driver, digital image data, control data and a clock signal which are included in an input signal, wherein the lock fail data is included in the input signal in preset period;

a logic circuit configured to process the recovered digital image data; and an arithmetic circuit configured to generate a first reset signal in response to a lock signal corresponding to the recovered lock fail data, and output the first reset signal to the recovery circuit and the logic circuit, wherein the recovery circuit and the logic circuit are reset in the preset period in response to the first reset signal, wherein the preset period is set to at least one frame, and wherein the recovery circuit receives the jock fail data from timing controller at intervals of the at least one frame.

9. The data driving device of claim 8, wherein the arithmetic circuit enables the first reset signal in response to at least one of the lock signal and an output signal of a reset circuit, the output signal being enabled during power on.

10. The data driving device of claim 8, wherein the recovery circuit and the logic circuit receive a second reset signal from a timing controller in each preset period, and are reset in response to at least one of the first and second reset signals.

11. The data driving device of claim 8, wherein the data driving device is connected to the timing controller through a dedicated transmission line for transmitting the second reset signal.

* * * * *